US008429775B2

(12) United States Patent
North

(10) Patent No.: US 8,429,775 B2
(45) Date of Patent: Apr. 30, 2013

(54) SUSPENDED BACK PILLOW FOR SUSTAINING A SIDE SLEEPING POSITION

(76) Inventor: Vaughn W. North, Salt Lake City, UT (US)

( * ) Notice: Subject to any disclaimer, the term of this patent is extended or adjusted under 35 U.S.C. 154(b) by 606 days.

(21) Appl. No.: 12/581,732

(22) Filed: Oct. 19, 2009

(65) Prior Publication Data

US 2010/0319131 A1 Dec. 23, 2010

Related U.S. Application Data

(63) Continuation-in-part of application No. 12/490,143, filed on Jun. 23, 2009, now Pat. No. 7,874,032.

(51) Int. Cl.
*A47C 20/00* (2006.01)
*A47G 9/10* (2006.01)
*A61F 5/37* (2006.01)

(52) U.S. Cl.
USPC ..... 5/633; 5/630; 128/871; 128/869

(58) Field of Classification Search ..... 5/633, 632, 5/630, 655, 652, 930; 128/848, 846, 871, 128/869; 2/1
See application file for complete search history.

(56) References Cited

U.S. PATENT DOCUMENTS

| | | | |
|---|---|---|---|
| 2,304,235 | A | 12/1942 | Boots |
| 2,562,725 | A | 7/1951 | Leto et al. |
| 2,629,884 | A | 2/1953 | McMonagle |
| 2,765,480 | A | 10/1956 | Mueller |
| 2,952,856 | A | 9/1960 | Ruff |
| 3,485,241 | A | 12/1969 | Polley |
| 3,924,282 | A | 12/1975 | Bond |
| 4,274,673 | A | 6/1981 | Kifferstein |
| 4,506,396 | A | 3/1985 | Ritchie et al. |
| 4,528,981 | A | 7/1985 | Behar |

(Continued)

FOREIGN PATENT DOCUMENTS

EP 2130459 12/2009

OTHER PUBLICATIONS

U.S. Appl. No. 11/495,497, filed Jul. 28, 2006; William Zohlmann.
U.S. Appl. No. 12/975,144, filed Dec. 21, 2010; Vaughn W. North.

(Continued)

*Primary Examiner* — Robert G Santos
(74) *Attorney, Agent, or Firm* — Thorpe North & Western LLP

(57) ABSTRACT

A device and method for enabling an individual located on a bed to sustain a side-sleeping orientation on either a left or right side. The device comprises a light weight, elongate pillow having a longitudinal axis and being configured to rest at a back side of the individual when reclined in a side-sleeping orientation on the bed. The pillow includes attachment structure which is positioned along a longitudinal edge of the pillow to secure the pillow to the individual. The attachment structure provides sufficient flexibility to allow the pillow to rotate with respect to and rest against the individual's back to a laterally offset and suspended configuration in general alignment with the individual's spine. The method includes the steps of attaching the light weight, elongate pillow at the back side of the individual positioned in the side sleeping orientation on the bed and with pillow contact laterally offset from the spine between the back side of the trunk portion and the pillow, thereby capturing the pillow between the bed and back side of the individual upon attempted rotation of the body to a supine sleeping position.

12 Claims, 9 Drawing Sheets

U.S. PATENT DOCUMENTS

| | | | | |
|---|---|---|---|---|
| 4,744,117 | A | 5/1988 | Bond | |
| 4,754,509 | A | 7/1988 | Pollard | |
| 5,040,546 | A | 8/1991 | Deluhery | |
| 5,044,026 | A | 9/1991 | Matthews | |
| 5,165,130 | A | 11/1992 | Wending | |
| 5,182,828 | A | 2/1993 | Alivizatos | |
| 5,189,748 | A | 3/1993 | Garrison et al. | |
| 5,193,238 | A | 3/1993 | Clute | |
| 5,216,772 | A | 6/1993 | Clute | |
| 5,272,780 | A | 12/1993 | Clute | |
| 5,289,748 | A | 3/1994 | Kuchta et al. | |
| 5,310,245 | A | 5/1994 | Lyszczasz | |
| 5,331,699 | A * | 7/1994 | Patton et al. | 5/655 |
| 5,341,531 | A | 8/1994 | Straub et al. | |
| 5,347,669 | A | 9/1994 | Neviaser et al. | |
| 5,359,739 | A | 11/1994 | Rains et al. | |
| 5,367,730 | A | 11/1994 | Sher | |
| 5,450,640 | A * | 9/1995 | Patton et al. | 5/655 |
| 5,499,418 | A | 3/1996 | Tan et al. | |
| 5,522,104 | A | 6/1996 | Little | |
| 5,530,974 | A | 7/1996 | Rains et al. | |
| 5,535,467 | A | 7/1996 | Ciske | |
| 5,581,832 | A | 12/1996 | Bridley | |
| 5,754,998 | A | 5/1998 | Selton | |
| 5,910,080 | A | 6/1999 | Selton | |
| 6,009,873 | A | 1/2000 | Neviaser | |
| 6,067,679 | A | 5/2000 | Rice | |
| 6,081,950 | A | 7/2000 | Selton | |
| 6,357,444 | B1 * | 3/2002 | Parker | 128/848 |
| 6,381,787 | B1 | 5/2002 | Rogone et al. | |
| 6,560,800 | B1 | 5/2003 | Draves | |
| 6,640,366 | B1 | 11/2003 | Draves | |
| 6,698,432 | B2 | 3/2004 | Ek | |
| 6,779,526 | B2 * | 8/2004 | Kawamura | 128/848 |
| 6,877,176 | B2 | 4/2005 | Houghteling | |
| 6,886,201 | B1 | 5/2005 | Weiss-Lohrei | |
| 6,954,954 | B2 | 10/2005 | Stelnicki | |
| 6,971,715 | B2 | 12/2005 | Hankins | |
| 7,107,635 | B2 | 9/2006 | Henry et al. | |
| 7,117,553 | B2 | 10/2006 | Fairchild et al. | |
| 7,134,435 | B2 | 11/2006 | Scott | |
| 7,240,384 | B2 | 7/2007 | DuDonis | |
| 7,360,265 | B2 | 4/2008 | Lamer | |
| 7,874,032 | B2 * | 1/2011 | North et al. | 5/632 |
| 8,015,975 | B2 * | 9/2011 | Zohlmann, Jr. | 128/848 |
| 2001/0015208 | A1 | 8/2001 | Konishi | |
| 2003/0200590 | A1 | 10/2003 | Haskell | |
| 2004/0031492 | A1 | 2/2004 | Kawamura | |
| 2005/0087194 | A1 * | 4/2005 | Scott | 128/846 |
| 2007/0256695 | A1 | 11/2007 | Crocetti | |
| 2008/0023011 | A1 * | 1/2008 | Zohlmann | 128/848 |
| 2008/0092297 | A1 | 4/2008 | Davis | |
| 2009/0038077 | A1 | 2/2009 | Han | |
| 2009/0229054 | A1 | 9/2009 | Yates et al. | |
| 2009/0229618 | A1 | 9/2009 | Sotelo et al. | |
| 2009/0313760 | A1 | 12/2009 | Blake et al. | |
| 2009/0313761 | A1 | 12/2009 | North et al. | |
| 2010/0088824 | A1 | 4/2010 | Tanner | |
| 2010/0319131 | A1 | 12/2010 | North | |

OTHER PUBLICATIONS

U.S. Appl. No. 11/495,497, filed Jul. 28, 2006; Vaughn W. North; office action issued Feb. 18, 2011.

Rematee positional sleeping solutions for sleep apnea, maternity, snoring, 2009, 4 pages.

PCT Application PCT/US2011/065933; filing date Dec. 19, 2011; Vaughn W. North; ISR mailed Mar. 28, 2012.

North, U.S. Appl. No. 12/490,143, filed Jun. 23, 2009.

U.S. Appl. No. 12/898,556; filed Oct. 5, 2010; Vaughn W. North; office action dated Nov. 21, 2012.

* cited by examiner

SUSPENDED BACK PILLOW FOR SUSTAINING A SIDE SLEEPING POSITION

This application is a continuation in part of U.S. patent application Ser. No. 12/490,143 filed Jun. 23, 2009 which is incorporated by reference in its entirety herein.

BACKGROUND OF THE INVENTION

1. Field of the Invention

The present invention relates generally to a method for assisting a person to regulate sleeping positions during a semi-conscious or unconscious state, such as to remain on a side while sleeping and thereby avoid sleeping in a supine position.

2. Related Art

Sleep positional orientation may be an important factor for many persons in preserving health. For example, the typical dominant period of healing for the human body occurs during sleep. Similarly, periods of illness or recovery often require additional rest that involves extended bedtime and sleep. During times of sleep, semi-consciousness or unconsciousness, the position of the body is seldom within the person's conscious awareness. One may be changing positions among basic orientations of lying on one's back, left side, right side, and front. In addition, there are transitional positions between each of these basic positions (partially on back and left side, etc) that further define a near continuum of position orientations for the human body while in a bed-rest condition.

It is recognized that certain body positions may be preferred or even required during sleep and rest for effective health recovery and/or health maintenance. For example, persons having sleep apnea are more vulnerable to disruption of sleep when lying in a back or supine orientation, as compared to sleeping on a side. Similarly, individuals with a snoring problem may be less inclined to snore when in a side-sleeping position. In addition, relative physical positioning of parts of the body may be important, such as when one has a shoulder injury, spine misalignment, hip problem, etc. Even the process of aging may be affected by disposing the body in particular sleep or rest orientations that avoid stressing certain muscle groups and skeletal relationships. In short, a system or methodology of facilitating and controlling a more healthy positional orientation during sleep or rest would be beneficial.

SUMMARY OF THE INVENTION

The present invention is a device and method for enabling an individual located on a bed to sustain a side-sleeping orientation on either a left or right side. The device comprises a light weight, elongate pillow having a longitudinal axis and being configured to rest at a back side of the individual when reclined in a side-sleeping orientation on the bed. The pillow includes attachment structure positioned along a longitudinal edge of the pillow to secure the pillow to the individual. The attachment structure provides sufficient flexibility to allow the pillow to bi-directionally rotate with respect to and rest against the individual's back to a laterally offset and suspended configuration in general alignment with the individual's spine. The method is practiced in two stages with stage one being applied in accordance with the parent patent application which defines a positional sleep orientation aspect (POSA) procedure of positional therapy to acclimate an individual to sleeping on a side, rather than in supine position. Once so acclimated, stage two is accomplished by attaching the light weight, elongate pillow at the back side of the individual in a suspended configuration, with a longitudinal axis of the pillow substantially aligned with the individual's spine and in a manner that simulates contact between the individual's back side and the first pillow as experienced during sleep in the first stage method of POSA. The individual is then positioned in a side-sleeping orientation on the bed and with pillow contact laterally offset from the spine between the back side of the trunk portion and the pillow, thereby facilitating capture of the pillow between the bed and back side of the individual upon attempted rotation of the body to a supine sleeping position. This position and similar side-sleeping positions are sustained with the laterally offset contact of the light weight pillow over a sufficient period of time prior to and during sleep to establish a sustainable recognition and awareness to the individual of being in the side-position orientation. By positioning the pillow at the individual's spine, a bi-directional hinge aspect can be achieved allowing the same pillow to function on both the right and left sides of the individual.

Other objects and features of the present invention will be apparent to those skilled in the art from the following detailed description, taken in combination with the accompanying drawings.

EMBODIMENTS OF THE INVENTION

Figure 1:
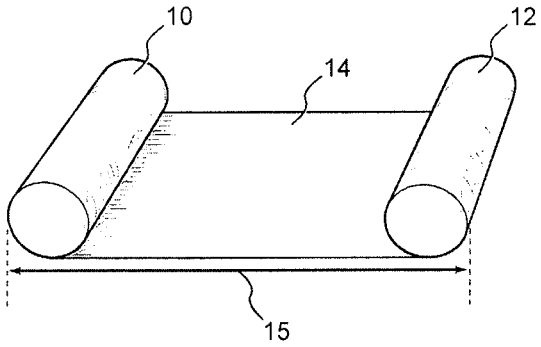
FIG. 1 illustrates a perspective view of a dual pillow system as disclosed in the parent patent application, including two opposing pillows tethered to an intermediate member.

The parent patent application described a method and device involving a pair of opposing pillows tethered together in accordance with concepts represented by an invention referred to as Positional Orientation Sleep Aspect (POSA). Under normal circumstances, a person moves through various sleeping positions (right or left side and back or front) in a random manner. This mobility is an important factor for a healthy sleep experience. It is generally undesirable, therefore, to limit the body to one sleeping position such as may occur by simply imposing pillows snuggly at front and back sides of the individual in a restraining manner. Although positioning a pillow at a single side of an individual can initially place the individual in a preferred side position, once the body moves away from the pillow, its positioning value is substantially compromised.

Positional Orientation Sleep Aspect (POSA) is a methodology and pillow system (FIG. 1) which helps a person achieve desired side sleeping positions without excessive restriction of movement. It utilizes an arrangement of pillows 10 and 12 having a limited width 15 and being coupled together by an intermediate member 14. This pillow system may be viewed as an ongoing sleep aid, or alternatively as a position conditioning tool as part of positional therapy, assisting an individual to form a new habit of sleeping on a side rather than in a supine position. As used in this application, reference to "side" will usually refer to a lateral portion of the individual's trunk, as opposed to the front and back of the individual. References to "front side" or "back side" should be understood to mean the front and back of the individual, as opposed to the lateral sides corresponding to the location of the arms.

A typical sleeping environment is a bed 20 (FIG. 2) or other substantially flat surface which supports the body of the individual in a generally horizontal plane. In this sense, the contact surface of the bed is one-dimensional in that the individual's body has a single side of contact—be it the front, back or one of opposing sides. This one-dimensional contact is acceptable during periods of being awake because the individual can simply make a mental decision to remain in the side-sleeping orientation. Being alert prior to sleep, the individual simply chooses his body position. As he falls into a state of sleep, however, he typically loses this sense of awareness. In a semi or subconscious state, the individual typically moves about without this mental awareness and is not able therefore to control a positional preference.

Over time, an individual may acclimate to various positional tendencies, such as sleeping on one's side or back, and these tendencies may even become somewhat habitual. Unfortunately, those individuals having a habitual tendency to sleep on their back may find themselves more prone to snoring or other breathing problems such as sleep apnea. In these situations, the need to shift from sleeping on one's back to a side-sleeping orientation has been very difficult to achieve. Strategies have usually involved physically forcing the individual to assume the desired position. Specifically, the use of restraining pillows and devices compressed against the body that thereby block movement have often been required. Some sleep apnea patients have been encouraged to place a tennis ball or other stiff object on their back, to discourage a supine position. However, this method is both uncomfortable and physiologically problematic. With methods involving the attachment of a ball or other stiff object to a central back location by pockets, straps or to a night gown or pajama top, physiological discomforts are likely. For example, if the individual attempts to roll onto his back, the ball creates irritation or discomfort under the back. Although the ball prevents supine repositioning, the person is typically aroused and may have difficulty returning to sleep.

With respect to the use of foam pad or other padded devices attached to the person's back, the user experiences discomfort from captured body heat or simply persistent contact of the object against his back while lying on one side. Although seemingly incidental at any given moment, prolonged contact over a large surface area or sustained weight against the back becomes the focus of mental attention to the individual and ultimately may be perceived as an uncomfortable nuisance.

Although prior art efforts to suspend objects at a person's back seem harmless, the above mentioned issues eventually discourage their continued use. This is particularly true if the person is not comfortable with sleeping on their side, but prefers sleeping on their back. Upon falling asleep, he may unconsciously assume that supine position out of habit—increasing the adverse conditions of sleep apnea or snoring.

As mentioned above, the seemingly minor discomfort of a back-mounted device can also become a psychological irritant. For example, the weight of the object resting or hanging against the person's back in a side orientation may become distracting and annoying. Even a nominal weight becomes uncomfortable after several minutes. For a person trying to relax and fall asleep, the slight pressure of the object at one sustained location becomes the focus of attention. After several minutes, the nominal pressure of the object becomes significant and eventually very uncomfortable. The person soon finds himself trapped between two unfavorable options—a side position with the ongoing attached object lying against his back, or a supine position where the object is captured between his back and the bed surface in an unacceptable and sometimes painful location.

The captured position of the object (tennis ball, foam structure or other stiff support device) also creates several physiological problems that trigger a threat response to the body. For example, a tennis ball captured under the back will bear the weight of the individual on a localized, minimal surface area, causing significant pain or discomfort. Theoretically, the prior art deemed this threat response to be a positive effect, in that it would alert the individual to rotate back to a side position. Unfortunately, this type of therapy is physically annoying to the individual, and generates a negative attitude or disposition. The use of a foam pad suspended by straps or a harness also gives rise to discomfort from their confining nature as well as the natural response of the body to sweat from captured body heat at the foam pad contact surface. The pad may also have an abrupt edge that results in localized pressure in a similar manner. As a consequence, the individual may readily abandon the positional therapy. From an emotional or mental perspective, both the captured and suspended configurations of the object against the back simply become one more stress element that inhibits a relaxed state of mind for restful sleep.

The present invention provides a continuation of the POSA method for enabling an individual to mentally sustain a favorable inclination for a desired sleeping position rather than being physically forced to do so. Applying this invention to a sleep environment allows the person to move through a variety of positions with substantial freedom, yet maintain a preference for the desired side-sleeping orientation. This is accomplished by developing a frame of reference for the mind and body based on a positional orientation sleep aspect (POSA). This is realized with a three-dimensional frame of reference to the body through appropriate contact points in a three-dimensional domain. Specifically, by establishing and maintaining at least two respective contact points at the forward and back sides of the individual, in addition to a third point of contact of the person on the bed surface, an increased mental awareness of the body's orientation can be sustained, despite the unconscious state of the individual during sleep. Case studies applying POSA to medical patients have suggested that this awareness may operate even while moving through various changing positions, ultimately returning the individual to a desired side-sleeping orientation.

The first point of reference in the POSA is contact of the trunk portion of the individual in the side-position orientation on the bed as shown in the figures. This naturally occurs based on the body being on the bed surface. Normally, this contact would extend along the length of the person, such as from the head, through the trunk and legs, down to the feet. This is referred to as a single point of contact, however, because in the frame of reference, it constitutes a single side of the individual. In the present invention, a primary interest is to establish either the right or left side of the individual as the first point of contact. In other words, the first point of reference is contact of the body in the side-position orientation on the bed. Because the present invention uses a pillow combination (FIGS. 1 and 2) comprising opposing first and second pillows 10 and 12 tethered between an intermediate member 14 positioned on the bed 20, the actual contact of the individual includes contact of a trunk portion of the body with the intermediate member 14 on the bed.

A second point of reference is contact of a back side 13 of the trunk portion with an adjacent side of the first pillow 10. This contact may be at the shoulders or hips, and any point there between. The nature of the contact arises from the stiffness and size of the pillow. The pillow needs to be sufficiently stiff to resist the weight of the body against it, yet soft enough to be comfortable to body contact.

It is desired that the pillow be sufficiently large in diameter to impede movement of the body over the pillow. Typically, at least a three inch diameter is desired; however, users have discovered that larger diameter pillows can be used as needed, particularly for obese patients. Individual preference is typically determined by balancing the minimal size needed to restrain movement of the user with the maximum size that can be managed conveniently for (i) pillow placement, (ii) maneuvering the individual to and from the pillow combination, and (iii) convenient storage of the device. A variety of sizes will be practical, when considering these minimum and maximum size considerations for different sized individuals.

The pillow also needs to be sufficiently stiff and resilient such that it does not overly compress under weight of the body and can thereby support and resist the second contact point of the POSA. Various pillow materials are available to meet this requirement and have been discussed in the parent application. Inflatable bladders are particularly well suited for the pillow and include inflated air pillows or even balloons. These offer the advantage of adjustable stiffness, based on a variable degree of inflation of the pillow. They are also light in weight and do not bear against the body in the manner will a heavier pillow. This light-weight comfort of the inflatable pillow may be a significant factor for persons that are sensitive to objects against their body.

A further advantage of the inflated pillow is dissipation of body heat that is captured at the contact point of the pillow with the individual's back. An inflated pillow allows transfer of body heat to air or gas contained within the pillow and typically provides a more comfortable temperature environment for the user. In contrast, foam pillows, down inserts and other highly insulative materials can trap body heat and cause a person to sweat during the night. Finally, the air bladder offers the advantage of deflation. Specifically, it can be deflated for transport or storage and therefore offers the benefit of a smaller shipping or storage space.

A third contact reference point for the POSA as described in the parent application includes contact of a forward projecting limb (arm or leg) of the individual with the second pillow 12. This contact may be with a knee 40, 42 in FIG. 3 or an elbow in a restraining configuration with the opposing pillows at maximum separation based on forceful resistance supplied by the fixed length of the thigh or upper arm, or a relaxed contact with less force between the second pillow and a lower leg or foot, and/or forearm or hand.

Figure 2:
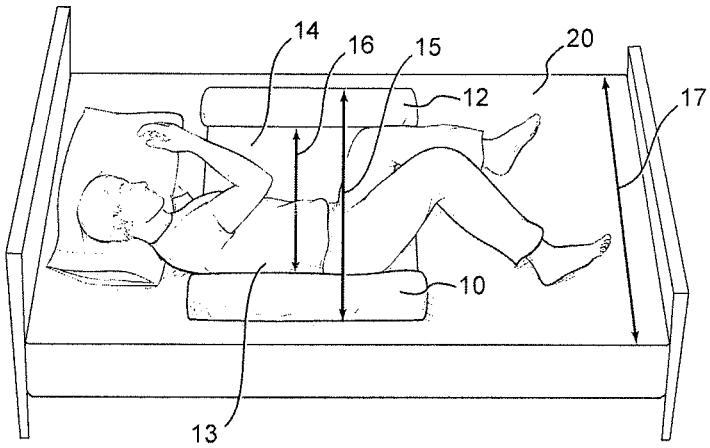
FIG. 2 depicts a graphic, perspective view of the invention in use on a bed with the pillow system fully extended.
Figure 3:
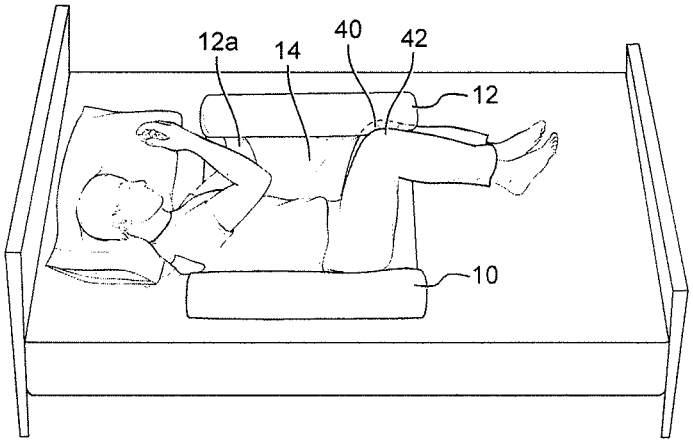
FIG. 3 illustrates in perspective an individual using the dual pillow system in a captured position between his knees.
Figure 4:
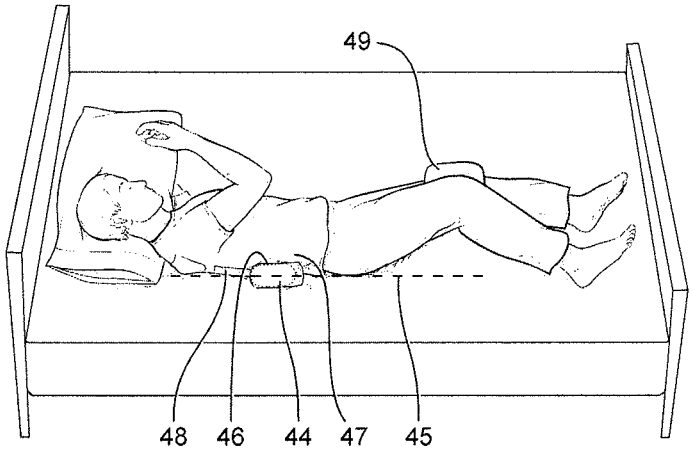
FIG. 4 represents a perspective view of a suspended back pillow for limiting rotation of a person in bed from assuming a supine position.

FIG. 4 illustrates this third point of contact with a knee pillow 49, which has been shown to be particularly helpful after the person is conditioned to sleeping on their side with some form of knee contact 40/42 as illustrated in FIG. 3. In this embodiment, however, the person is using a back pillow 44 in combination with the knee pillow as a substitute for the dual pillow system of FIGS. 1-3. This is explained in detail hereafter.

Specifically, the parent application teaches that a person can become acclimated to sleeping on one side by maintaining the three points of reference of the POSA system during normal sleep. Over a period of time, this side-sleeping position can become a psychologically preferred position and may thereby actually work to the benefit of the user's health. The combination of back pillow and knee pillow can thereby serve as a simulation of the full POSA system represented by FIGS. 2 and 3. Specifically, the mind and body respond to the contact at the back pillow 44, in combination with the pillow contact at the knees 49, such that the three points of reference are satisfied and the body perceives that it is in the preferred side-sleeping position. The result is that the mind and body are both psychologically and physiologically satisfied within the POSA objective of having forward and rearward contact points as a frame of reference. In accordance with prior habitual side sleeping patterns realized within the dual pillow system of FIGS. 1 and 2, the user feels secure and remains on his side.

The advantage of the back pillow configuration is that it is much smaller and more comfortable to use. An individual is also able to more easily occupy a bed with a partner and get in and out of bed without the limitations of the dual pillow structure as part of the bed surface. In essence, the person carries the positioning back pillow on his back without having to consciously manage its positioning or disposition as with the dual pillow system. Because of this, the individual is more likely to permanently continue the positional therapy of maintaining a side-sleeping orientation with the attendant benefits of improved cardiovascular health.

Figure 9:
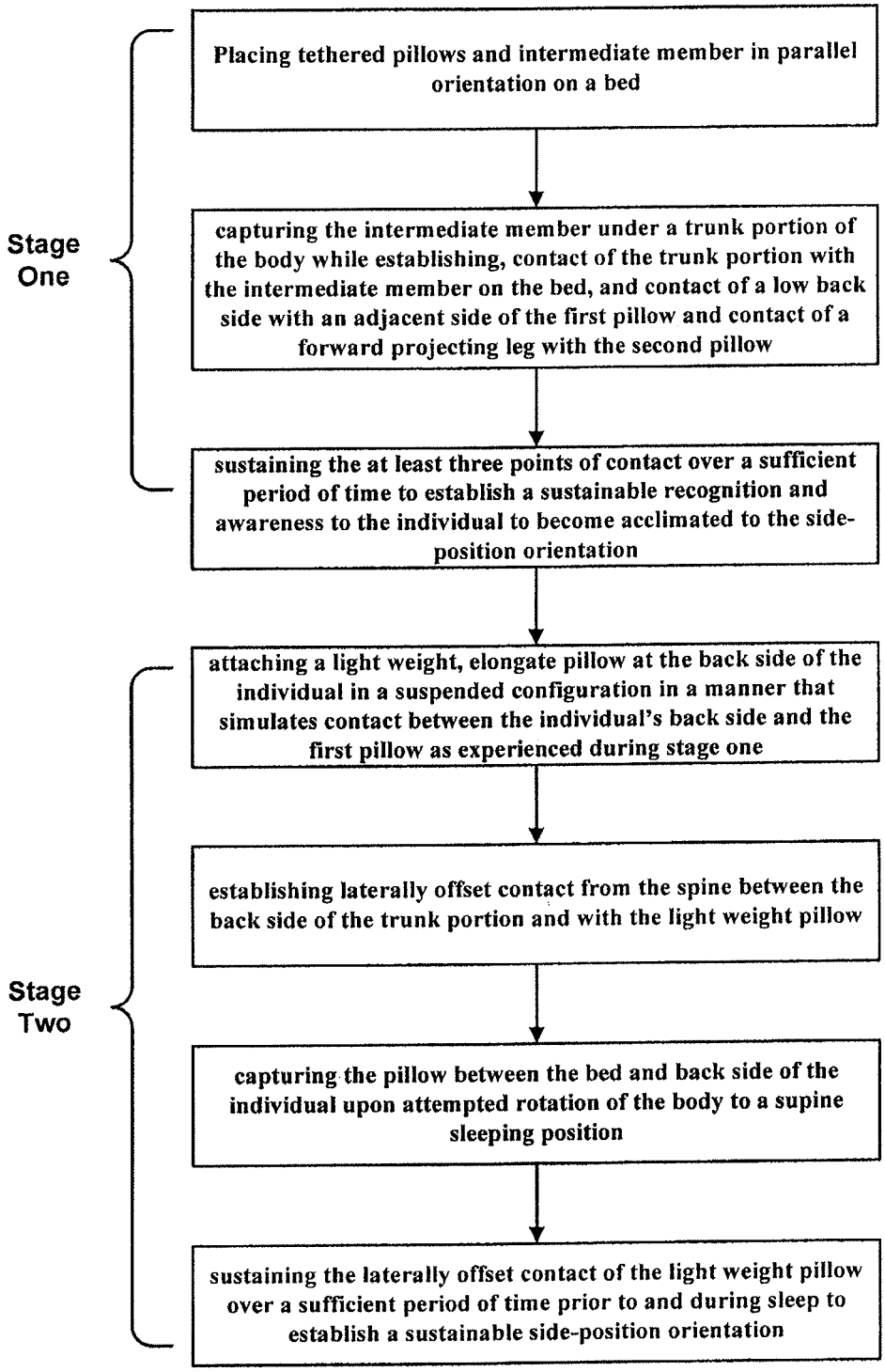
FIG. 9 illustrates one method of practicing the present invention.

Turning to the specific features and methods of the present invention, FIGS. 1 through 3 illustrate the basic dual pillow system as used in the aforementioned POSA methodology. This is summarized as a method for developing a positional orientation sleep aspect (POSA) to enhance individual awareness of sleeping position to enable the individual located on a bed 20 of fixed width 17 to assume at least one preselected side-sleeping orientation alternately on either a left or right side. The method involves two stages of physical assistance using pillows in the following method as illustrated in FIG. 9: Stage one, utilizing a pillow combination having a full transverse span 15 shorter than the fixed width 17 of the bed and including first and second elongate pillows tethered together at a separation distance 16 in parallel orientation by an intermediate member 14 for providing concurrent support at forward and back sides of the individual, stage one method comprising steps of:

a) placing the tethered pillows 10 and 12 on the bed 20 with the tethered pillows in the parallel orientation;

b) positioning the individual's body in a preselected, side-position orientation on the intermediate member to capture the intermediate member under a trunk portion 13 of the body while establishing at least three separate and concurrent points of contact including (i) contact of the trunk portion in the side-position orientation with the intermediate member 14 on the bed, (ii) contact of a back side 13 of the trunk portion with an adjacent side of the first pillow 10, and (iii) contact of a forward projecting leg from the trunk portion with the second pillow 12;

c) sustaining the at least three points of contact over a sufficient period of time prior to and during sleep to establish a sustainable recognition and awareness to the individual during sleep to become acclimated to the side-position orientation while allowing the individual freedom of movement to also assume alternate positions between the pillow combination, including free movement of the individual's limbs; and Stage two, to commence following the individual becoming acclimated to sleeping in the side-position orientation, comprising the subsequent steps of:

d) attaching a light weight, elongate pillow 44 at the back side of the individual in a suspended configuration, with a longitudinal axis 45 of the pillow substantially aligned with the individual's spine and in a manner that simulates contact between the individual's back side and the first pillow 10 as experienced during sleep in the first stage method of POSA;

e) positioning the individual's body in the preselected, side-position orientation on the bed and having body contact laterally offset from the spine between the back side of the trunk portion 47 with the pillow;

f) capturing the pillow between the bed and back side of the individual upon attempted rotation of the body to a supine sleeping position; and g) sustaining the laterally offset contact of the light weight pillow over a sufficient period of time prior to and during sleep to establish a sustainable recognition and awareness to the individual of being in the side-position orientation.

Reference to "laterally offset contact" relates to the relative position of back contact of the pillow 44 with respect to the spine and the bed surface. Specifically, that portion of the back of the individual which is between the side of the body lying on the bed and the back portion proximate to the spine is referred to as the "laterally offset" portion of the back along area 47 extending from the waist to the shoulder area. Corresponding positions would occur on both sides of the individual, to the left and right of the spine.

It should be noted in FIGS. 2 and 3 that the first pillow 10 contacts this laterally offset portion of the back or trunk of the individual when sleeping on a side. During the process of positional therapy in the POSA method, the individual becomes accustomed to pillow contact in this region of the body during sleep. Over time, a person can develop a sense of comfort in response to this contact which can assist in the sleep process. Whether this is an association that develops mentally or is simply a physical response to familiar contact is uncertain. However, the favorable environment associated with pillow contact in this laterally offset location may be simulated by the back pillow without need of the full, dual pillow system.

Figure 5:
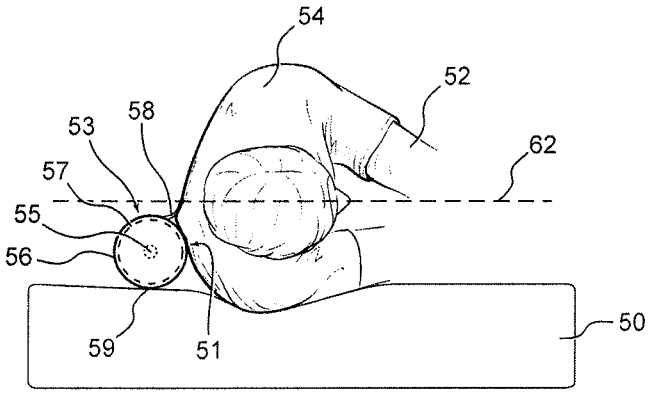
FIG. 5 shows a plan, top end view of the back pillow illustrating a hinged configuration as part of a night shirt.

As illustrated in FIG. 5 showing an individual 52 lying on a bed 50 on his right side, the back pillow 53 provides this contact when positioned in a similar manner and location as shown in the drawings. This occurs when the pillow 53 is essentially worn with the pajamas, tank top or night gown 54 or is otherwise similarly attached to the individual's body. This is accomplished by suspending the light weight pillow 53 from an attachment location by an attachment member 58 extending from and generally parallel with the spine of the individual. When attached at the this area, the pillow can then displace to either the right or left side, depending upon which side the individual selects as a sleeping side. Because of the attachment member location 58 on the side of the pillow, the pillow body will hang down and in contact or near contact with both the appropriate back side of the individual and the bed surface 59. Reference to attachment at the side or along an edge of the pillow generally refers to attachment at a single edge of the pillow which preserves a hinge function to the pillow. Whereas some prior art devices are attached to night shirts or pajamas, such attachment is often at multiple sides of a pocket or pad, thereby limiting their rotational movement. The present invention, however, favors such hinge action in order to facilitate displacement of the pillow to opposing sides of the spine. Therefore, although an attachment strip 48 or 58 may have several locations of fixation to the pillow (sewing or adhesive, etc.) the strip itself represents a single attachment edge because it preserves the desired hinge function along an edge of the pillow.

The attachment member may be with a strip of Velcro® or any other convenient attachment means capable of coupling the pillow at the individuals back. In addition to supplying a key frame of reference contact 51 at the individuals back and thereby simulating the side-sleeping environment conditioned within the POSA methodology, the location of the back pillow impedes movement of the individual to a supine sleeping position. Because the pillow is attached at an edge of the cylindrical pillow body, it will hang under force of gravity toward the bed surface. This causes rotation of the pillow 53 and its longitudinal axis 55 downward and away from a central 62 or spine reference point, and into resting contact or near contact with the laterally offset portion of the individual's back 51, proximate to the bed surface. Typically, a portion of the bed clothing will fall downward with the pillow as illustrated, adjusting the pillow location even more toward the laterally offset back region as shown. When the individual attempts to roll into a supine position, the pillow is captured between the bed 50 and the laterally offset back portion at 51, blocking further rotation of the body.

Another advantage of this invention occurs upon initial contact of the user with the pillow upon attempting to rotate into a supine position. When a light weight, balloon pillow 53 is used as disclosed hereafter, the initial contact and resistance is very gentle, with the balloon component 57 within a sleeve 56 compressing slightly and avoiding an abrupt force on the individual's back. As the gentle contact intensifies with continued movement, the increasing resistance of the pillow is usually sufficient to urge the body back to a side-sleeping orientation without waking the person. Thereafter, the pillow again assumes its hanging or suspended configuration, lying near or against the laterally offset portion of the back.

A further benefit of the present invention arises with the hinge aspect of the attachment to the bed clothing or support band. With the pillow attached near the spine in a central location 62, the individual may shift from one side to another and the pillow will automatically gravitate to the appropriate laterally offset location. Specifically, under force of gravity the pillow will fall between alternating and opposing laterally offset contact positions at the individual's back based on the side sleeping position selected—whether on the right or left side. For example, if the person represented in FIG. 5 on his right side were to shift to the left side in contact with the bed, the pillow and attached clothing would fall to the opposing left side, displacing the contact point 51 to the left of centerline 62. Based on this feature of the invention, the pillow automatically makes adjustment and is effective for both right and left side-sleeping positions, impeding rotation of the body to a supine position upon capture of the pillow between the bed 50 and opposing lateral portions of the back side of the individual adjacent to the bed.

Figure 6:
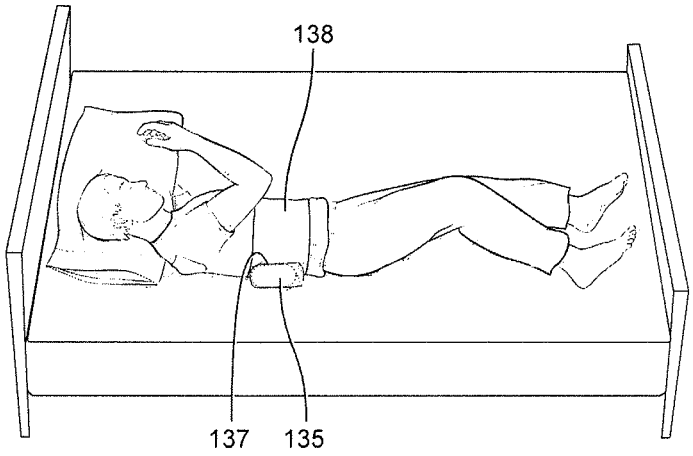
FIG. 6 depicts a perspective view of an additional embodiment of the back pillow utilizing a body band for supporting the back pillow.
Figure 7:
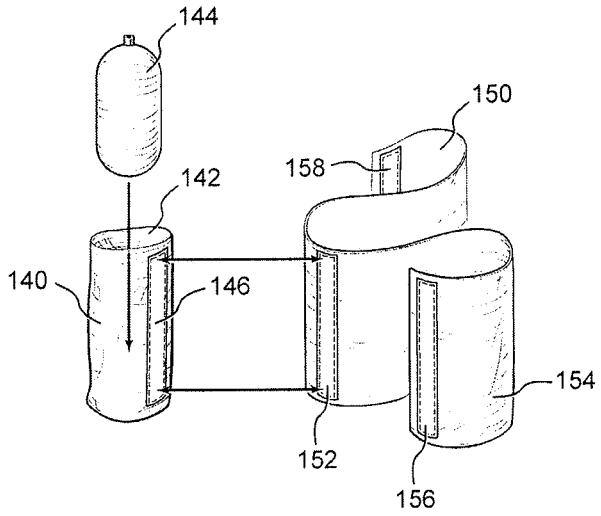
FIG. 7 shows isolated perspective views of the separated body band and pillow.

FIG. 6 illustrates an alternate method of attachment, wherein the elongate pillow 135 is suspended from a support band 138 worn around the trunk of the individual. Velcro® or other attachment means 137 can be used to attach the pillow. The band can be a fabric girdle or other form of wrap that can be vertically positioned along the torso to place the pillow at a desired location. One embodiment is shown in FIG. 7 wherein the band 150 comprises a fabric material having opposing Velcro® attachment members 156 and 158 at opposing ends to secure it to the individual. An additional attachment member 152 enables fixation of the pillow and is positioned at an intermediate location suitable for alignment with the spine of the user.

This embodiment includes a two-piece pillow configured to be very light in weight and simple in construction, as light as 1 to 3 ounces. It comprises a sleeve member 140 having an interior open space 142 and configured in a desired shape suitable for the back pillow. The dimensions of the sleeve will typically be between six and eighteen inches in length, with a diameter of three to eight inches. The sleeve can be fabricated of flexible, light weight material such as polymer or natural fabric. A complementary attachment member 146 is formed along one edge of the sleeve for receiving the attachment member 152 of the body band.

A balloon component 144 is positioned within the open space of the sleeve member and provides resilience to the pillow. Ideally, the balloon component conforms to the cylindrical shape of the sleeve when inflated. By using these materials, the pillow has a very low mass of less than 12 ounces, and ideally less than 5 ounces. A cotton fabric sleeve of 12 inch length and 4 inch diameter and an inflated interior balloon was very effective and had a total weight of less than 2 ounces. With this light weight character, the user hardly notices the presence of the pillow at his back.

This minimal weight can best be realized in an embodiment wherein an un-inflated elongate balloon is inserted within the sleeve and inflated to fill the open space. For transport and storage, the balloon pillow requires less than three cubic inches of space and is of nominal weight. The sleeve, in combination with the inflated balloon, forms a light weight balloon pillow capable of supplying the desired POSA contact reference point on the laterally offset portion of the back, as well as functioning to maintain the person in a side sleeping position against unconscious attempts to shift to a supine orientation. This compact and light weight feature allows the device to be transported conveniently under virtually any circumstances, particularly in situations where a standard CPAP device would be impractical.

The following discloses a method of use comprising the steps of positioning the balloon pillow at the laterally offset portion of the individual's back and providing a gradual cushioned resistance response through gentle compression of the balloon component as the individual attempts to rotate to a supine position. In accordance with this method, the pillow provides (i) a gradual gradient increase of resistance against rotation of the individual to minimize discomfort while (ii) gently restoring the individual to the desired side-sleeping orientation. This gradual gradient increase commences at a null point of resistance so that the body is barely to register a sudden incidence of contact with the pillow. This gradient remains low to maintain a high level of comfort to the individual as contact pressure increases. By avoiding a sudden contact force when rolling to the supine position, the body appears to be able to generally register the contact and resume the side sleeping position without arousing or awakening the sleeper. This is accomplished by using a balloon component in which the skin of the balloon (such as a party balloon) is very thin and remains pliable under pressure to conform to the body shape, based on a sufficiently low air pressure within the balloon. This is in contrast to other prior art structures having somewhat rigid outer skin structure that is less pliable and with which body contact serves to alert the individual of immediate contact.

The embodiments discussed thus far share a common characteristic of angular adjustment about the attachment location and/or spine of the user. In the case of the pillow and attached bed clothing, the angular rotation of the pillow occurs in part because of the typical loose nature of bed clothing as shown in FIG. 5, in combination with allowed movement of the attachment member 58. The amount of displacement will usually be a matter of taste for the individual, but is preferred to be at least 5 degrees of movement with respect to a central reference point identified as 62. Greater angular rotation can be applied to increase the displacement away from the spine and into close contact with the bed. Accordingly, when located approximately centrally at the back of the individual, the pillow is adapted to automatically adjust to a side-sleeping orientation on either a left or right side.

Generally, therefore, one embodiment of the present invention can be described as a light weight, elongate pillow having a longitudinal axis and being configured to rest at a back side of the individual when reclined in a side-sleeping orientation on the bed, the pillow including attachment structure positioned along a longitudinal edge of the pillow to secure the pillow to the individual, the attachment structure having sufficient flexibility to allow the pillow to rotate with respect to and rest against the individual's back to a laterally offset, suspended configuration in general alignment with the individual's spine. Ideally, the rotation of the pillow should be at least 5 degrees of angular rotation with respect to and away from the spine, and as much as 45 degrees, where a separate hinge member is provided.

Figure 8:
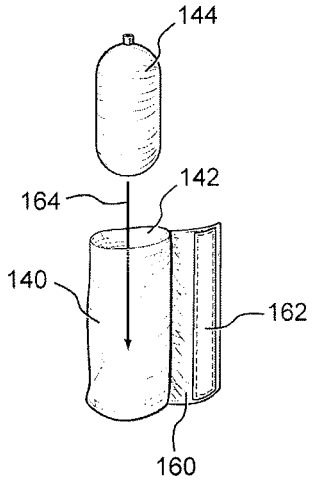
FIG. 8 is a perspective view of a pillow sleeve with attached hinge member illustrating insertion of a balloon member for inflation therein.

FIG. 8 illustrates an alternate form of attachment which includes a flexible, light weight hinge component 160 coupled to the pillow sleeve at one side and to the attachment member 162 on the other side. The material composition of the hinge member is preferably thin and flexible to provide for unimpeded rotation of the pillow and its elongate axis 164 with respect to the spine. The length of the hinge component may extend at least a half inch from the pillow edge but at no greater length than will allow the pillow to fall to the laterally offset contact position at the individual's back based on the individual's size, providing an extended radius of rotation to the pillow member to position the pillow to a suspended rest position in contact with the individual's back and proximate to the bed.

For example, an individual of average size may have require a hinge member of only up to one inch in length, whereas a person of very large stature may need a length of two or more inches, depending upon the diameter of the pillow and softness of the mattress on the bed. It will be apparent that a soft mattress will allow the person to sink into the mattress body, increasing the proximity to the suspended pillow. Ideally, the pillow should fall to a position in contact with the individual's back and in near contact with the bed surface. Accordingly, the back pillow may require tailoring in size to the body dimensions of the user in order to properly function as disclosed, resulting in capture of the pillow between the laterally offset back area and the bed when the individual attempts to rotate to a supine position.

As shown in FIG. 8, the attachment member 162 may be coupled directly to a mating attachment member on either bed clothing 54 or a body band 138. Various mechanisms for attachment will be apparent to those skilled in the art. The selection of materials may include numerous structures and configurations, including a continuous hinge member as shown in the drawing, or alternatively, connecting straps, strings, tabs, films and similar flexible materials. A thin fabric material such as nylon, silk or light weight cotton effectively provides the benefits of a substantially resistance-free aspect.

With the hinged embodiment, the pillow will hang lower towards the bed and may apply slightly more contact pressure at the user's back than is acceptable, particularly if partially captured between the bed and offset back area. This can readily be resolved by the user reaching behind the back and releasing the captured pillow from between the bed and back side of the individual by slightly tilting or displacing the pillow away from the back to a non-captured, resting position on the bed. Although there may be a slight contact at the offset back side, the nominal weight of the pillow is substantially unnoticeable when it is resting primarily on the bed. Accordingly, this last step provides a static, non-supine sleep condition with substantially no contact pressure by the pillow on the individual for maximum comfort.

It is to be understood that the foregoing examples and illustrations are merely representative of various embodiments which are comprehended by the following claims and are not, therefore, to considered limiting except as required to sustain validity of the claims.

I claim:

1. A device for enabling an individual located on a bed to sustain a side-sleeping orientation on either a left or right side, said device comprising: a light weight, elongate pillow having a longitudinal axis and being configured to rest at a back side of the individual when reclined in a side-sleeping orientation on the bed; said pillow including attachment structure to secure the pillow to the individual, said attachment structure being positioned along a longitudinal edge of the pillow in general alignment with the individual's spine and having sufficient flexibility to allow the pillow and its longitudinal axis to bi-directionally rotate with respect to and rest against the individual's back to a laterally offset contact position; wherein, said attachment structure includes a flexible, lightweight hinge component coupled to the pillow at the exterior edge and positioned along a central longitudinal axis of the attachment structure.

2. A device as defined in claim 1, wherein the elongate pillow has a cylindrical configuration having a length less than 18 inches and a diameter less than 8 inches.

3. A device as defined in claim 1, wherein the attachment structure comprises (i) bed clothing worn around the trunk of the individual and (ii) an attachment member coupled between the bed clothing and the elongate pillow, the combination of clothing and attachment member being configured to provide the sufficient flexibility to allow the pillow to rotate with respect to the individual's spine and rest against the individual's back to a laterally offset, suspended configuration in general alignment with the individual's spine.

4. The device as defined in claim 3, wherein the rotation of the pillow is within the range of 5 to 45 degrees of angular rotation with respect to and away from the spine.

5. The device as defined in claim 1, wherein the hinge member extends at least a half inch from the pillow edge but at no greater distance than will allow the pillow to fall to the laterally offset contact position at the individual's back based on the individual's size, providing an extended radius of rotation to the pillow member to position the pillow to a suspended rest position in contact with the individual's back and proximate to the bed.

6. The device defined in claim 1, wherein the pillow comprises an inflatable balloon component providing minimal weight of less than 6 ounces for light contact pressure for the pillow with respect to the individual's back.

7. A device as defined in claim 1, comprising a light weight pillow formed by a sleeve member having an interior open space and configured in a desired shape for the back pillow and an inflated balloon component within the open space of the sleeve member to fill the open space and form a light weight balloon pillow to support the sleeve against substantial collapse under weight of the individual.

8. A device as defined in claim 7, wherein the pillow is configured with a cylindrical cross-section and a length of at least six inches and a diameter of at least three inches.

9. A device as defined in claim 7, wherein the total weight of the sleeve and balloon pillow is less than 10 ounces.

10. A device as defined in claim 7, wherein the total weight of the sleeve and balloon pillow is within the range of 1 to 4 ounces.

11. A device for enabling an individual located on a bed to sustain a side-sleeping orientation on either a left or right side, said device comprising: an elongate pillow having a longitudinal axis and being configured to rest at a back side of the individual when reclined in a side-sleeping orientation on the bed; and an attachment member for supporting the pillow at the individual's back including a flexible, light weight hinge component coupled to the pillow along a single pillow edge, having a central longitudinal axis substantially aligned with the longitudinal axis of the pillow and configured to allow the pillow to fall freely into contact at either a laterally offset left or right back side of the individual when the individual is lying on the respective left or right side.

12. A device as defined in claim 11, wherein the hinge component has a length from the pillow of at least a half inch from the pillow edge but at no greater length than will allow the pillow to fall to a laterally offset contact position at the individual's back based on the individual's size.

* * * * *